US006394291B2

(12) United States Patent
Maier-Hunke

(10) Patent No.: US 6,394,291 B2
(45) Date of Patent: May 28, 2002

(54) DEVICE FOR THE PIVOTABLE MOUNTING OF INFORMATION CARRIERS

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 0 days.

(21) Appl. No.: 09/741,273

(22) Filed: Dec. 19, 2000

(30) Foreign Application Priority Data

Aug. 2, 2000 (DE) ..... 100 38 632

(51) Int. Cl.[7] ..... A47F 5/00
(52) U.S. Cl. ..... 211/169; 211/48; 211/96
(58) Field of Search ..... 211/169, 168, 211/47, 48, 96

(56) References Cited

U.S. PATENT DOCUMENTS 3,200,958 A * 8/1965 Hudgeons et al.
3,330,418 A * 7/1967 Schneider ..... 211/47
3,603,461 A * 9/1971 Best ..... 211/47
4,066,168 A * 1/1978 O'Toole et al. ..... 211/42
5,551,577 A * 9/1996 Hagopian ..... 211/96 X
5,715,949 A * 2/1998 Rutledge ..... 211/47
5,746,330 A * 5/1998 DiBetta ..... 211/169 X
5,782,366 A * 7/1998 Garza ..... 211/169

FOREIGN PATENT DOCUMENTS

DE 20005100 6/2000

OTHER PUBLICATIONS

Schafer Shop Hauptkatalog 2000, p. 557.

* cited by examiner

*Primary Examiner*—Robert W. Gibson, Jr.
(74) *Attorney, Agent, or Firm*—Mark P. Stone

(57) ABSTRACT

In a device for the pivotable mounting of information carriers (2) provided with pivot pins, provision is to be made for the respectively outer information carriers (2) to assume a certain end position, i.e., in particular, they do not swing rearward. In order to achieve this aim with simple means, it is proposed to provide at least one of two retaining webs (5, 6) with end stops formed by punched tongues (24, 25), which retaining webs (5, 6) are provided with holes (18) for accommodating the pivot pins of a multiplicity of information carriers (2), are designed as sheet-metal punched parts and are connected to one another via a back part (4).

12 Claims, 2 Drawing Sheets

DEVICE FOR THE PIVOTABLE MOUNTING OF INFORMATION CARRIERS

BACKGROUND OF THE INVENTION

The invention relates to a device for the pivotable mounting of information carriers, such as reversible boards, reversible pockets, reversible envelopes or the like, which are each provided at a longitudinal margin with two aligned pivot pins directed in opposite directions, in which device a holder designed as a sheet-metal punched part serves to accommodate the pivot pins, the holder having a back part and two retaining webs which project forward at the top and bottom margins of the back part, run essentially parallel to one another and are provided with rows of holes with the holes in each case aligned in pairs for accommodating the pivot pins, and in which the pivoting movement, directed away from the center of the back part, of the information carriers mounted on the outer margins of the holder is limited by end stops.

A device of the above type is known in which the end stops are formed by wire straps bent several times, the offset ends of which have to be inserted into holes of the top and bottom retaining webs by the user of the device before it is put into service and the yokes of which form abutments for the information carriers (SCHÄFER SHOP Hauptkatalog 2000, page 557). Compared with another known solution of the generic type in which the end stops are formed by lateral extension arms of the back part, the straps which can be hung in place offer the advantage that a plurality of devices can be arranged in a row and connected to one another to form a unit of greater holding capacity, only the respectively outer devices being equipped in such a case with a wire strap serving as an end stop.

The known device, inter alia, is unable to provide complete satisfaction insofar as the production of the wire straps causes comparatively high costs, which cannot be harmonized with the mass-produced-article character of relevant devices. There is also the fact that the spatial configuration of the wire straps entails problems with both storage and dispatch.

SUMMARY OF THE INVENTION

The object of the invention is to provide a device of the type considered which is provided with end stops which neither require assembly by the user of the device nor rule out the possibility of being able to couple a plurality of devices to form a unit and which, in addition, can be produced in an extremely cost-effective manner. This object is achieved in a device of the generic type in that the end stops are formed by punched tongues arranged in the region of the ends of at least one of the two retaining webs and directed toward the respectively opposite margin of the holder.

The device according to the invention offers the advantage that its holder can be produced in an exceptionally cost-effective manner and each holder is provided with integral end stops which do not exclude the possibility of a plurality of holders being lined up next to each other to form a unit.

BRIEF DESCRIPTION OF THE DRAWINGS

Further features and details of the invention follow from the subclaims and the description below of an embodiment shown in the attached drawing, in which:

DESCRIPTION FOR THE BEST MODES FOR CARRYING OUT THE INVENTION

Figure 1:
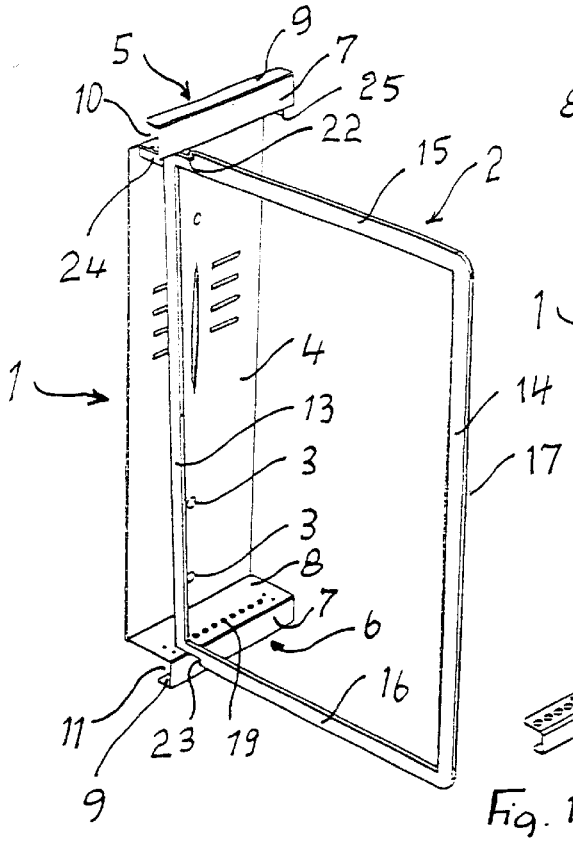
FIG. 1 shows a device with a holder which can be fastened to a wall.
Figure 2:
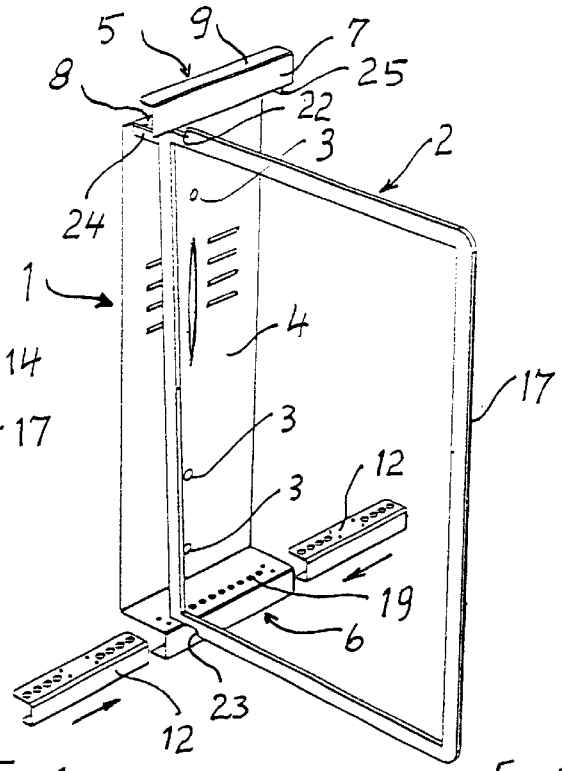
FIG. 2 shows the device according to FIG. 1 and two coupling elements for linking a plurality of devices to form a unit.
Figure 3:
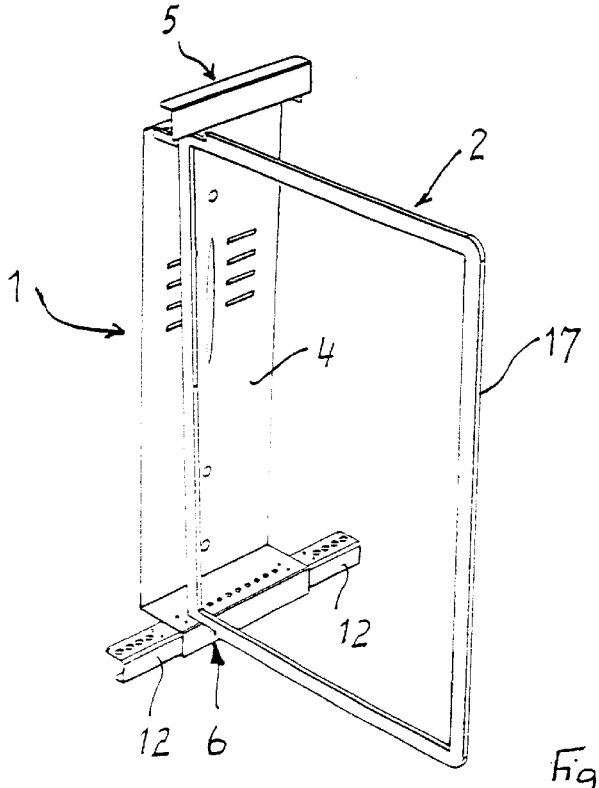
FIG. 3 shows the device according to FIG. 1 after it is connected to the coupling elements shown in FIG. 2.

The device shown in FIG. 1 has a holder 1 which is suitable for fastening to a wall and is intended for accommodating information carriers 2, of which only one has been shown. The holder 1 consists of a back part 4, which is provided with holes 3 for fastening screws (not shown), and of essentially L-shaped retaining webs 5 and 6 which adjoin the back part 4 at the top and bottom. The essentially L-shaped retaining webs 5, 6, which project beyond the front side of the back part 4, consist of two legs 8, 9 connected to one another via a yoke 7 and form U-shaped guides 10, 11 for accommodating coupling elements 12 which enable a plurality of holders 1 to be coupled.

The information carriers 2 shown in the drawing have a frame 17 which regularly holds a transparent envelope and has longitudinal margins 13, 14 and transverse margins 15, 16, and one longitudinal margin 13 of which, in a known manner, is provided at its ends with pivot pins 20, 21 which can be inserted into aligned holes 18, 19 of the retaining webs 5, 6. In order to be able to insert the pivot pins 20, 21 into the holes 18, 19, the frame 17 must have a certain flexibility. This flexibility may lead, in particular, to problems when all the frames 17, for example, assume a pivoted position relative to the same side of the holder 1. This is because, in this case, the frame-side stops 22, 23 on the transverse margins 15, 16 of the frame 17, which stops 22, 23 serve to limit the pivoting movements, are no longer sufficient to prevent the frame 17 from swinging rearward if there is no additional support, this rearward swinging being avoided in the known designs mentioned at the beginning by wire straps or wing-like lateral extension arms. In the present case, the function of the wire straps or extension arms is taken over by punched tongues 24, 25 arranged on the top retaining web 5 and punched out of its leg 8. To achieve high rigidity of the end stops formed by the punched tongues 24, 25, the punched tongues 24, 25 are formed by sections of the leg 8 of the retaining web, these sections being bent about an axis running perpendicular to the longitudinal axis of the retaining web 5 into a position oriented essentially perpendicularly to the leg 8.

Figure 4:
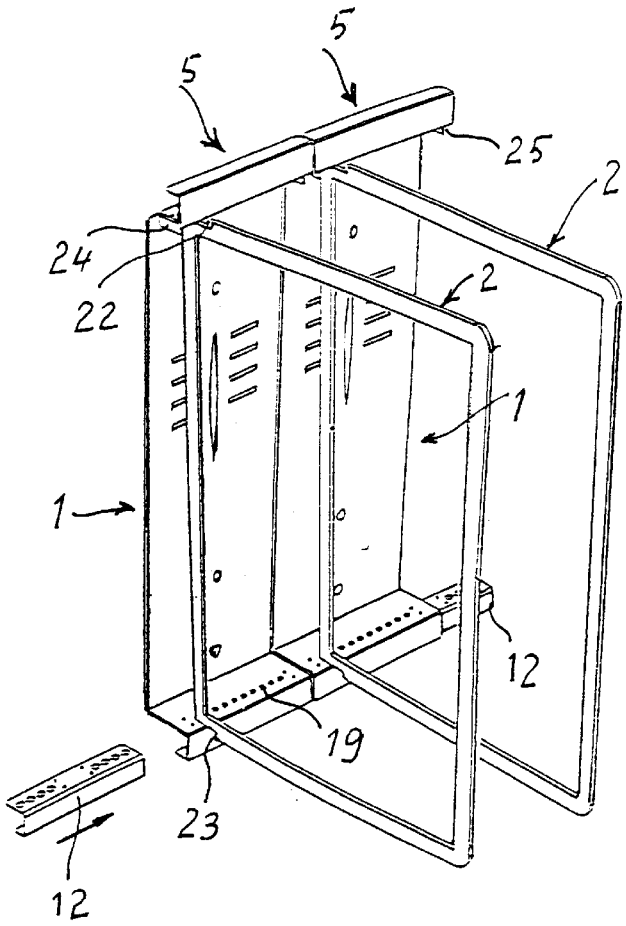
FIG. 4 shows two devices according to FIG. 1 connected to one another to form a unit by one of the coupling elements shown in FIGS. 2 and 3.
Figure 4:
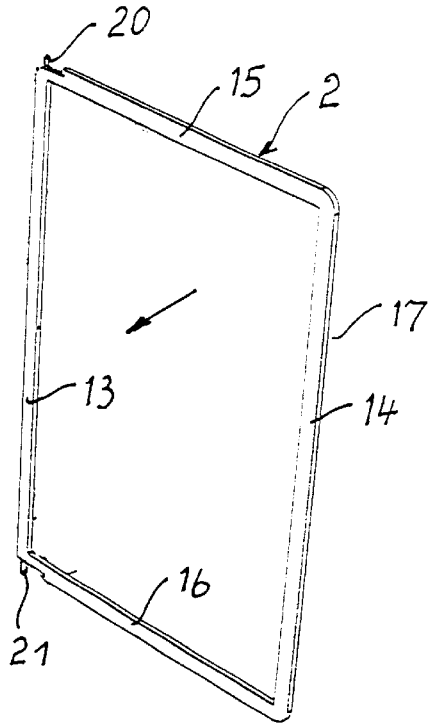
Figure 5:
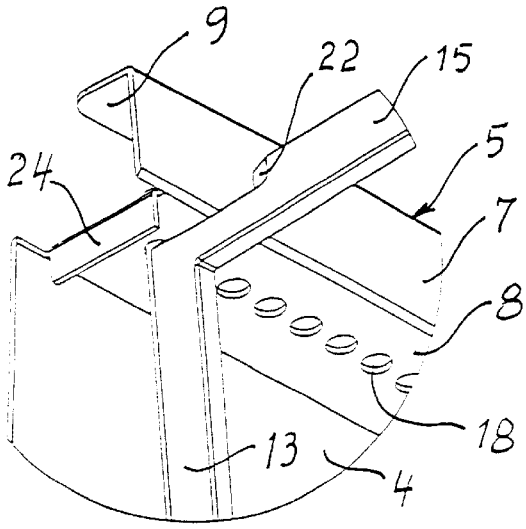
FIG. 5 shows a detail of FIG. 1.
Figure 6:
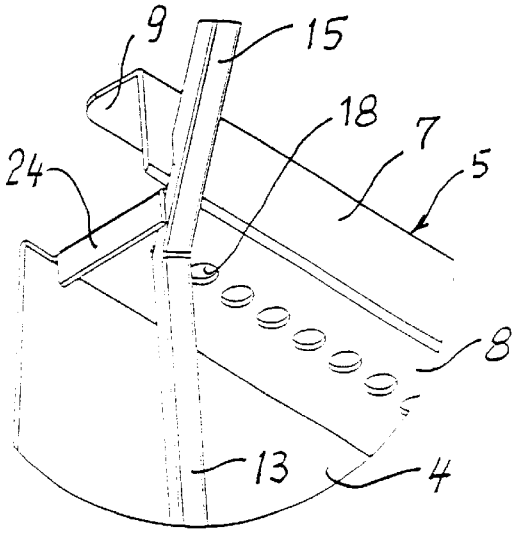
FIG. 6 shows the detail corresponding to the detail shown in FIG. 5 with an information carrier shifted into an end position.

As FIG. 4 clarifies, the stops 24, 25 do not prevent a plurality of holders 1 from being coupled together to form a device of greater holding capacity, the holders 1 being connected with the use of the coupling elements 12 in the manner disclosed by DE 200 05 100 8 U1.

What is claimed is:

1. A device for the pivotable mounting of information carriers, such as reversible boards, reversible pockets, or reversible envelopes, which are each provided at a longitudinal margin with two aligned pivot pins directed in opposite directions, in which device a holder designed as a sheet-metal punched part serves to accommodate the pivot pins, the holder having a back part and two retaining webs which project forward at top and bottom portions of the back part, run essentially parallel to one another and are each provided with a row of holes with the holes in each of said two retaining webs being aligned in pairs for accommodating the pivot pins, and in which the pivoting movement, directed away from the center of the back part, of the information carriers mounted on outer margins of the holder is limited by end stops, wherein the end stops are formed by punched tongues (24, 25) arranged in the region of the ends of at least one of the two retaining webs (5, 6) and directed respectively towards opposite said margins of the holder, wherein the punched tongues (24, 25) are formed by end sections of a leg (8) of said at least one retaining web (5) which adjoins the back part (4), said at least one retaining web (5) forming a U-shaped guide (10).

2. A device for the pivotable mounting of information carriers, such as reversible boards, reversible pockets, or reversible envelopes, which are each provided at a longitudinal margin with two aligned pivot pins directed in opposite directions, in which device a holder designed as a sheet-metal punched part serves to accommodate the pivot pins, the holder having a back part and two retaining webs which project forward at top and bottom portions of the back part, run essentially parallel to one another and are each provided with a row of holes with the holes in each of said two retaining webs being aligned in pairs for accommodating the pivot pins, and in which the pivoting movement, directed away from the center of the back part, of the information carriers mounted on outer margins of the holder is limited by end stops, wherein the end stops are formed by punched tongues (24, 25) arranged in the region of the ends of at least one of the two retaining webs (5, 6) and directed respectively towards opposite said margins of the holder, wherein the punched tongues (24, 25) are formed by sections of the retaining web (5), said sections being bent about an axis running perpendicular to the longitudinal axis of the retaining web (5) into a position oriented essentially perpendicularly to the retaining web (5).

3. A device for the pivotable mounting of information carriers, such as reversible boards, reversible pockets, or reversible envelopes, which are each provided at a longitudinal margin with two aligned pivot pins directed in opposite directions, in which device a holder designed as a sheet-metal punched part serves to accommodate the pivot pins, the holder having a back part and two retaining webs which project forward at top and bottom portions of the back part, run essentially parallel to one another and are each provided with a row of holes with the holes in each of said two retaining webs being aligned in pairs for accommodating the pivot pins, and in which the pivoting movement, directed away from the center of the back part, of the information carriers mounted on outer margins of the holder is limited by end stops, wherein the end stops are formed by punched tongues (24, 25) arranged in the region of the ends of at least one of the two retaining webs (5, 6) and directed respectively towards opposite said margins of the holder, wherein transverse margins (15, 16) of the information carriers (2), at ends thereof which face said longitudinal margin (13) provided with said pivot pins (20, 21), are provided with additional stops (22, 23) limiting pivoting movement thereof.

4. The device as claimed in claim 3, wherein the additional stops (22, 23) limit the pivoting travel of the outer information carriers (2) to a smaller value than the end stops formed by the punched tongues (24, 25).

5. The device as claimed in claim 4, wherein the end stops formed by said punched tongues (24, 25) come to bear against one of said transverse margins (15) of the information carriers (2) between the pivot pins (20, 21) and the additional stops (22, 23).

6. The device as claimed in claim 1, wherein the punched tongues (24, 25) are formed by sections of the retaining web (5), these sections being bent about an axis running perpendicular to the longitudinal axis of the retaining web (5) into a position oriented essentially perpendicularly to the retaining web (5).

7. The device as claimed in claim 1, wherein transverse margins (15, 16) of the information carriers (2), at ends thereof which face said longitudinal margin (13) provided with said pivot pins (20, 21), are provided with additional stops (22, 23) limiting pivoting movement thereof.

8. The device as claimed in claim 2, wherein transverse margins (15, 16) of the information carriers (2), at ends thereof which face said longitudinal margin (13) provided with said pivot pins (20, 21), are provided with additional stops (22, 23) limiting pivoting movement thereof.

9. The device as claimed in claim 7, wherein the additional stops (22, 23) limit the pivoting travel of the outer information carriers (2) to a smaller value than the end stops formed by the punched tongues (24, 25).

10. The device as claimed in claim 8, wherein the additional stops (22, 23) limit the pivoting travel of the outer information carriers (2) to a smaller value than the end stops formed by the punched tongues (24, 25).

11. The device as claimed in claim 9, wherein the end stops formed by said punched tongues (24, 25) come to bear against one of said transverse margins (15) of the information carriers (2) between the pivot pins (20, 21) and the additional stops (22, 23).

12. The device as claimed in claim 10, wherein the end stops formed by said punched tongues (24, 25) come to bear against one of said transverse margins (15) of the information carriers (2) between the pivot pins (20, 21) and the additional stops (22, 23).

* * * * *